US006931902B1

(12) United States Patent
Delp

(10) Patent No.: US 6,931,902 B1
(45) Date of Patent: Aug. 23, 2005

(54) TUBE FLARING MACHINE

(76) Inventor: Bryan Delp, 407 Locust, Burdett, KS (US) 67523

( * ) Notice: Subject to any disclaimer, the term of this patent is extended or adjusted under 35 U.S.C. 154(b) by 37 days.

(21) Appl. No.: 10/459,054

(22) Filed: Jun. 11, 2003

(51) Int. Cl.[7] ..... B21D 3/02

(52) U.S. Cl. ..... 72/117; 72/115; 72/124; 72/126

(58) Field of Search ..... 72/67, 112, 115, 72/117, 118, 119, 124, 125, 126

(56) References Cited

U.S. PATENT DOCUMENTS

| | | | | |
|---|---|---|---|---|
| 1,004,492 A | | 9/1911 | Stock | |
| 1,186,107 A | | 6/1916 | Lienau | |
| 1,752,508 A | | 4/1930 | Schultis | |
| 2,368,817 A | | 2/1945 | Fischer | |
| 2,962,079 A | * | 11/1960 | Wilson | 72/117 |
| 3,262,298 A | * | 7/1966 | Samuels et al. | 72/117 |
| 3,290,914 A | | 12/1966 | Vaill et al. | |
| 3,354,680 A | * | 11/1967 | Jacobsen | 72/126 |
| 3,477,265 A | | 11/1969 | Szitar, Jr. | |
| 3,648,500 A | | 3/1972 | Vaill | |
| 3,947,950 A | | 4/1976 | Adams | |
| 4,124,233 A | | 11/1978 | Ahlstone | |
| 4,397,173 A | | 8/1983 | Eftefield et al. | |
| 4,831,855 A | * | 5/1989 | Wagner | 72/118 |
| 5,956,987 A | | 9/1999 | Anthoine | |
| 6,327,771 B1 | | 12/2001 | Anglin et al. | |

* cited by examiner

*Primary Examiner*—Ed Tolan
(74) *Attorney, Agent, or Firm*—Kenneth H. Jack; Davis & Jack, LLC

(57) ABSTRACT

A tube flaring machine having a frame having an upper end and having a lower end; a tube clamp having a plurality of radially arranged clamping shoes; a collet ring and a gantry fixedly attached to and overlying the collet ring; a radially segmented anvil ring cumulatively forming an outwardly and downwardly flared anvil surface, the segments of the anvil ring being attached to lower ends of the clamping shoes; a mandrel including orbiting rollers having outwardly and downwardly flared outer surfaces; a mandrel guiding plate interconnecting the mandrel and the frame and positioning the mandrel below the anvil ring; a hydraulic motor for orbiting and rotating the rollers; and a hydraulic ram operatively connected to the frame for moving the mandrel and the anvil ring toward each other for compression and flaring therebetween of a pipe's end.

11 Claims, 4 Drawing Sheets

TUBE FLARING MACHINE

FIELD OF THE INVENTION

This invention relates to machinery for flaring the ends of large metal pipes and tubes.

BACKGROUND OF THE INVENTION

Where an end of a large steel pipe functions as a receptor having an end serving as a port for insertion of other objects such as, for example, a second pipe to be nestingly mounted within the bore of such receptor pipe, the end of the receptor pipe is advantageously outwardly flared. By outwardly flaring the end of such receptor or pipe, slight misalignments of the object to be inserted are accommodated, the outward flare effectively guiding the object into the bore of the receptor pipe.

Known and undesirably labor intensive means for flaring pipe ends include welding a short conical tube sections to pipe ends, and cold hammering or hot forge hammering the end of the pipe into a flare. Cold forming pipe flaring machinery is known to substantially overcome the undesirable labor intensive nature of flaring large pipes through hammering or through welded attachments. However, such machinery commonly ineffectively holds a pipe to be flared, fails to present any annular and flared "anvil" surface for effective flare forming, or fails to include a pipe flaring mandrel element which is capable of flaring a pipe in a radially balanced fashion.

The above noted drawbacks and deficiencies of commonly known methods and apparatus for flaring pipes are overcome by the instant inventive pipe flaring machine through its incorporation of a collet clamp having clamping shoes which are adapted to present and cumulatively form an annular and flared anvil surface; and further incorporating a pipe flaring mandrel comprising radially balanced, orbiting, and rotating conical rollers.

BRIEF SUMMARY OF THE INVENTION

A first structural component of the instant inventive pipe or tube flaring machine comprises a frame defining an interior space wherein a pipe is received and secured for end flaring. The frame preferably comprises a steel plate base or end member, preferably configured as a square, and four steel cylindrical columns mounted upon and extending upwardly or laterally from the base. Preferably, the four columns are arranged in a square pattern, and their lower ends are preferably fixedly welded to the base plate.

A further structural component of the instant inventive pipe flaring machine comprises a tube or pipe clamp and attaching means operatively positioning such clamp within the interior space of the frame. The tube clamp preferably comprises a collet ring whose bore has an outwardly and downwardly flared inner wall, and comprising a plurality of, preferably eight, tube clamping shoes arranged radially about the inner periphery of the collet ring. In operation, such shoes compressively move radially inward toward and against a pipe upon upward sliding motion of the shoes across the flared inner surface of the collet ring. Inwardly directed compression applied by the shoes to the pipe effectively secures the pipe in place within the frame. Suitably, though less desirably, other known pipe clamps may be substituted for the preferred collet and shoe clamp, such clamps including vice clamps and tensioned band clamps.

Where the preferred collet clamp is provided, the means for mounting such clamp within the frame preferably comprise an outward radial extension of the collet ring to fixedly, and preferably removably, join with the four columns of the frame. In such configuration, the collet clamp serves as an integral member of the frame. Other clamp attaching means such as braces, struts, or beams interconnecting the frame and the clamp may be suitably substituted for the preferred outward radial extension of the collet ring.

Where the tube clamp comprises the preferred collet clamp configuration, the tube clamp preferably further comprises a rectilinear motion actuator for alternately upwardly and downwardly moving the shoes within the collet's bore. Preferably, the rectilinear motion actuator comprises a plurality of hydraulic cylinders spanning between and interconnecting a gantry which overlies and is attached to the collet ring. Suitably, pneumatic cylinders may be substituted. Also suitably, jack screws may serve as rectilinear motion actuators. Numerous other commonly known rectilinear motion actuators may be suitably utilized for actuating the collet clamp.

A further structural component of the instant inventive tube flaring machine preferably comprises an anvil ring and means for axially mounting the anvil ring within the frame at an elevation immediately underlying the tube clamp. Where the tube clamp comprises the preferred collet clamp configuration, the anvil ring is preferably radially segmented to include a number of segments equal to the number of shoes. Where the preferred segmented anvil ring is provided, the upper ends of the segments are necessarily directly fixedly attached to lower ends of the shoes. Such fixed attachment may suitably comprise whole formation of the anvil ring segments and shoes as unitary articles, or may comprise heat fusion welded or bolted attachments. Such attachments of the anvil ring segments to the shoes comprise means for positioning the anvil ring within the frame. Suitably, though less desirably, the anvil ring may be non-segmented and the means for positioning the anvil ring within the frame may alternately comprise linkages supporting the anvil ring separately from the tube clamp elements. Regardless of whether the anvil ring comprises radially arranged segments or a continuous ring, the anvil ring necessarily presents an outwardly and downwardly flared pipe flaring anvil surface.

A further structural component of the instant inventive tube flaring machine comprises a pipe flaring mandrel having an outwardly and downwardly sloped or flared outer surface, and attaching means for interconnecting such mandrel and the frame. The attaching means preferably positions the mandrel so that it underlies the anvil ring. Preferably, the mandrel comprises a plurality of conical rollers mounted rollably upon a separately rotatable drive cone, the conical rollers being capable of orbiting and rolling motion about the drive cone. Also preferably, the means for attaching such mandrel to the frame comprises an apertured mandrel guiding plate which is slidably mounted upon the four columns for alternate upward and downward motion. Preferably, the lower periphery of the drive cone comprises a toothed gear. Also preferably, the lower bases of the orbiting roller cones comprise matching smaller toothed gears, and preferably the inner periphery of the aperture of the mandrel guiding slide plate comprises matching gear teeth. Also preferably, the upper ends of the orbiting roller cones are mounted upon the upper end of the drive cone by a three way rotary bearing facilitating orbiting and rolling motion of the rollers. In such configuration, the mandrel guiding slide plate is slidably carried alternately upwardly and downwardly by the drive cone and by the bases of the orbiting roller cones, while synchronized rotating and orbiting movement of the roller cones is guided by the three way rotary bearing and by the matching gear teeth of the roller cones, the drive cone, and the mandrel guiding plate.

Where the mandrel comprises the preferred plurality of orbiting roller cones, means for rotating the drive cone and the orbiting roller cones with respect to the mandrel guiding plate are preferably provided. Such means preferably comprises a hydraulic or electric motor mounted upon such plate and comprising a rotary drive linkage for transferring rotary power from such motor to the drive cone and to the orbiting roller cones.

Pressing means are necessarily provided for driving the mandrel and the anvil ring toward each other for pressing a pipe end therebetween and for flaring the pipe end. Preferably, the pressing means comprises a lower rectilinear motion actuator, preferably an hydraulic ram or jack screw, mounted upon the frame's base for driving upwardly against a lower surface of the mandrel. Alternately, the vertical position of the mandrel within the frame may suitably be fixed in place, and the pressing means may alternately drive the tube clamp, a pipe carried by the tube clamp, and the anvil ring toward the mandrel.

In use of the instant inventive tube flaring machine, the tube clamp is operated to hold and secure a pipe whose end is to be flared within the frame, and in a position wherein such end overlies the pipe flaring surface of the anvil ring. Thereafter, the pressing means is actuated to drive the mandrel and the anvil ring toward each other, compressing said pipe end therebetween, and flaring said pipe end.

Accordingly, objects of the present invention include provision of a pipe or tube end flaring machine comprising a frame, and comprising tube clamping means, an anvil ring, a mandrel and pressing means all mounted within the frame. Objects further include incorporation within such machine of a collet clamp whose shoes are configured to present and form an anvil ring. Objects further include incorporation within such machine of a mandrel comprising orbiting conical rollers which are orbitally and rotatably supported and linearly driven by an underlying drive cone.

Other and further objects, benefits, and advantages of the present invention will become known to those skilled in the art upon review of the following Detailed Description, and upon review of the appended drawings.

DETAILED DESCRIPTION OF A PREFERRED EMBODIMENT

Figure 1:
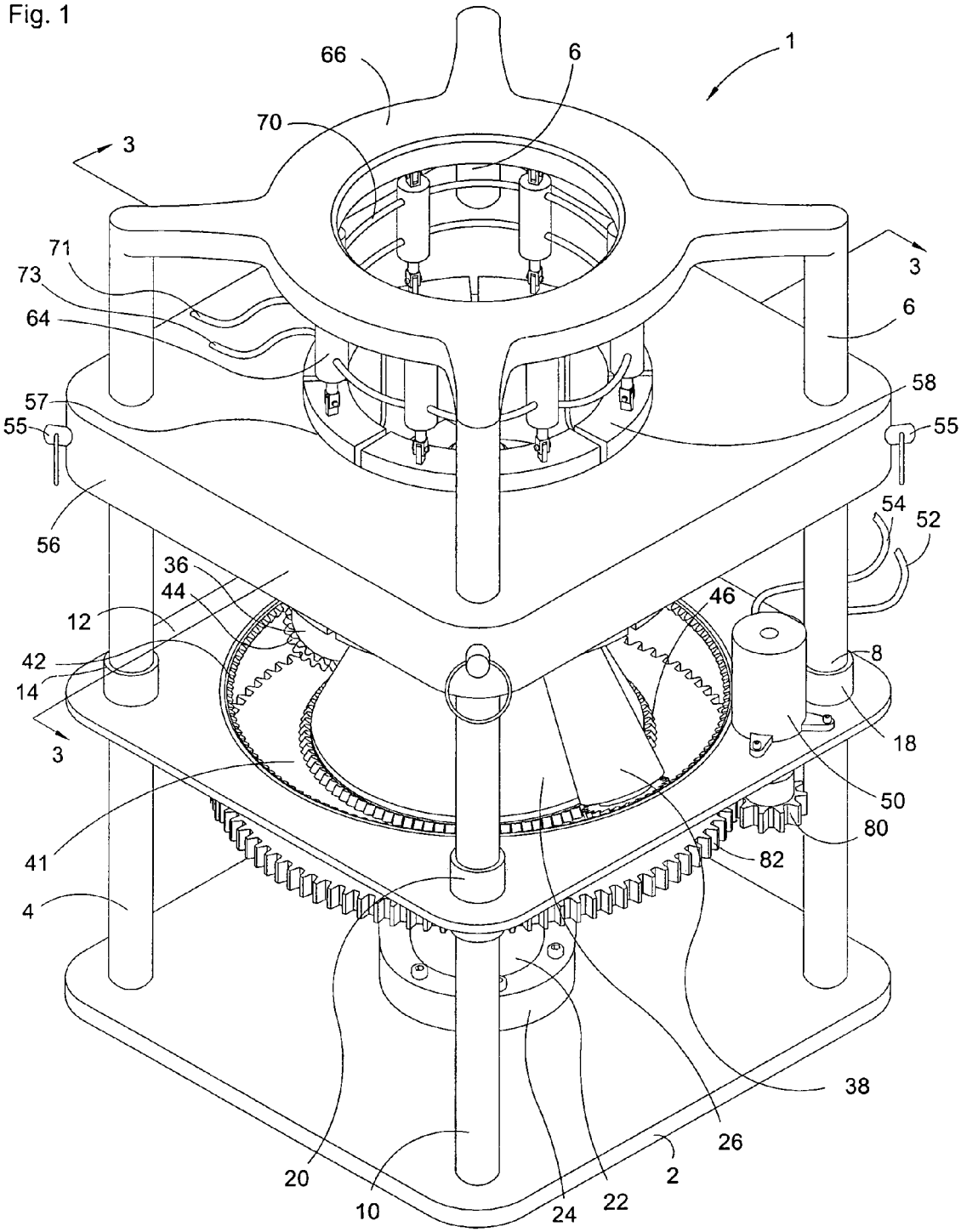
FIG. 1 is an isometric view of the instant inventive pipe or tube flaring machine.

Referring now to the drawings, and in particular to FIG. 1, the instant inventive tube flaring machine is referred to generally by Reference Arrow 1. The tube flaring machine 1 has a square steel base or end member 2 and has four steel columns 4 fixedly attached to the base 2 and extending upwardly therefrom. A gantry ring 66 having legs 6 overlies and is fixedly attached to a collet ring plate 56, the gantry ring 66 having a central pipe receiving opening. The base 2 in combination with columns 4 and collet ring plate 56 form a rigid box frame defining an interior space wherein pipes are received, secured, and wherein pipe ends are flared.

Preferably, the collet ring plate 56 has downwardly opening column receiving recesses (not within view) for receiving the upper ends of columns 4, and preferably shear pins 55 extend laterally through the collet ring plate 56, through such recesses, and through shear pin apertures within the upper ends of columns 4, forming shear pin locked sleeve joints. Such locking sleeve joint configuration advantageously allows for removal of the collet ring and gantry assembly from the frame, facilitating pass through of a flared pipe.

Figure 3:
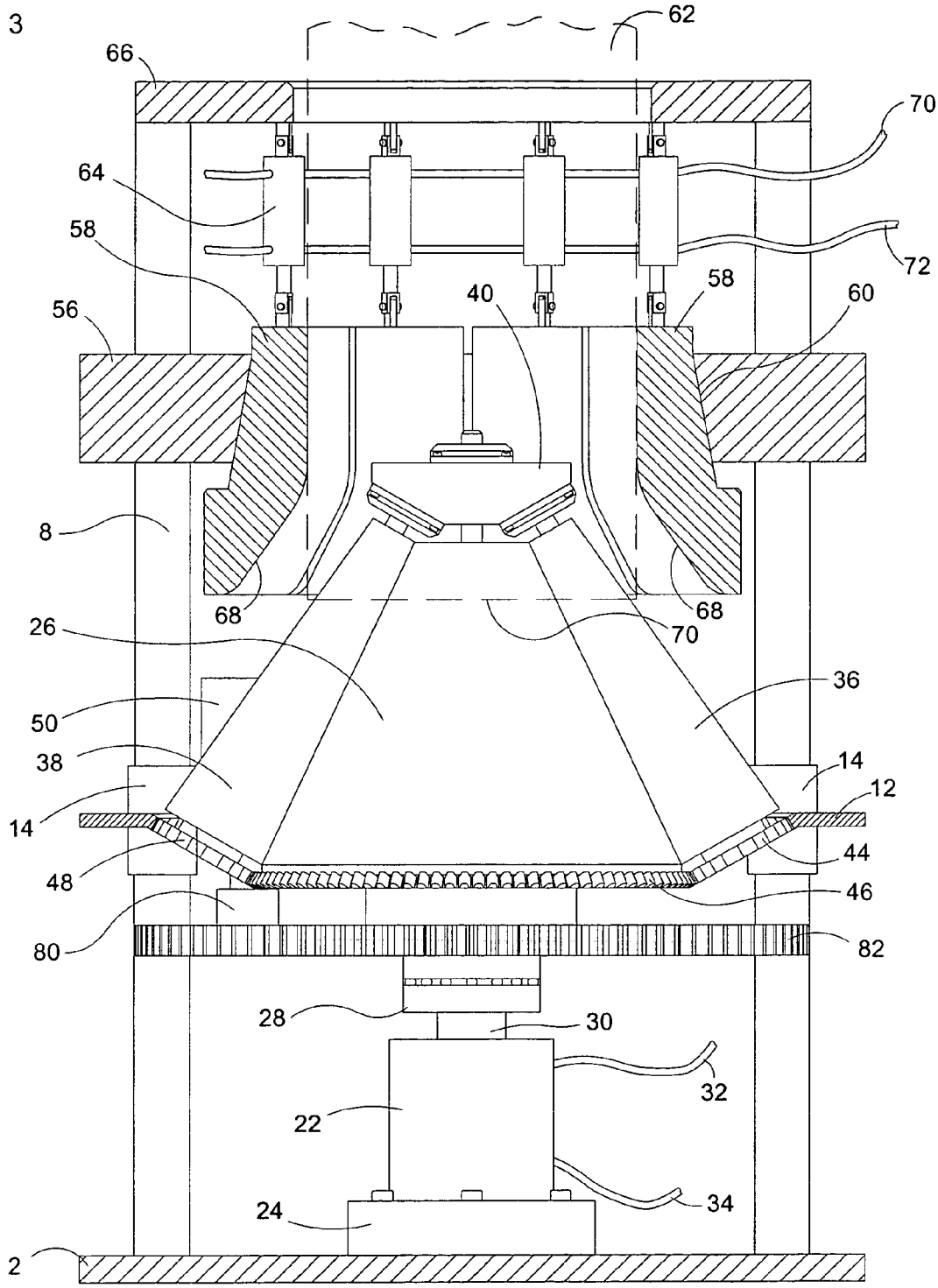
FIG. 3 is a sectional view as indicated in FIG. 1, the view showing conical rollers orbited 90°.

Referring simultaneously to FIGS. 1 and 3, eight clamping shoes 58 are arranged radially within the conical bore 57 of collet ring plate 56. Each clamping shoe 58 preferably has a downwardly and outwardly flared outer wall 60, the slope of such wall matching the slope of the inner wall of conical bore 57. The lower end of each clamping shoe 58 preferably comprises an anvil ring segment 68, such segments 68 presenting outwardly and downwardly flared pipe flaring surfaces.

Referring further simultaneously to FIGS. 1 and 3, hydraulic cylinders 64 powered by a network of hydraulic fluid bearing lines 71 and 73 span between and interconnect the gantry ring 66 and the upper ends of clamping shoes 58. Upon simultaneous actuation of hydraulic cylinders 64 to slidably draw clamping shoes upwardly through bore 57, the inner clamping surfaces of clamping shoes 58 move compressively inwardly, driving against pipe 62 and fixing pipe 62 in place with respect to the segmented anvil ring 68.

Figure 2:
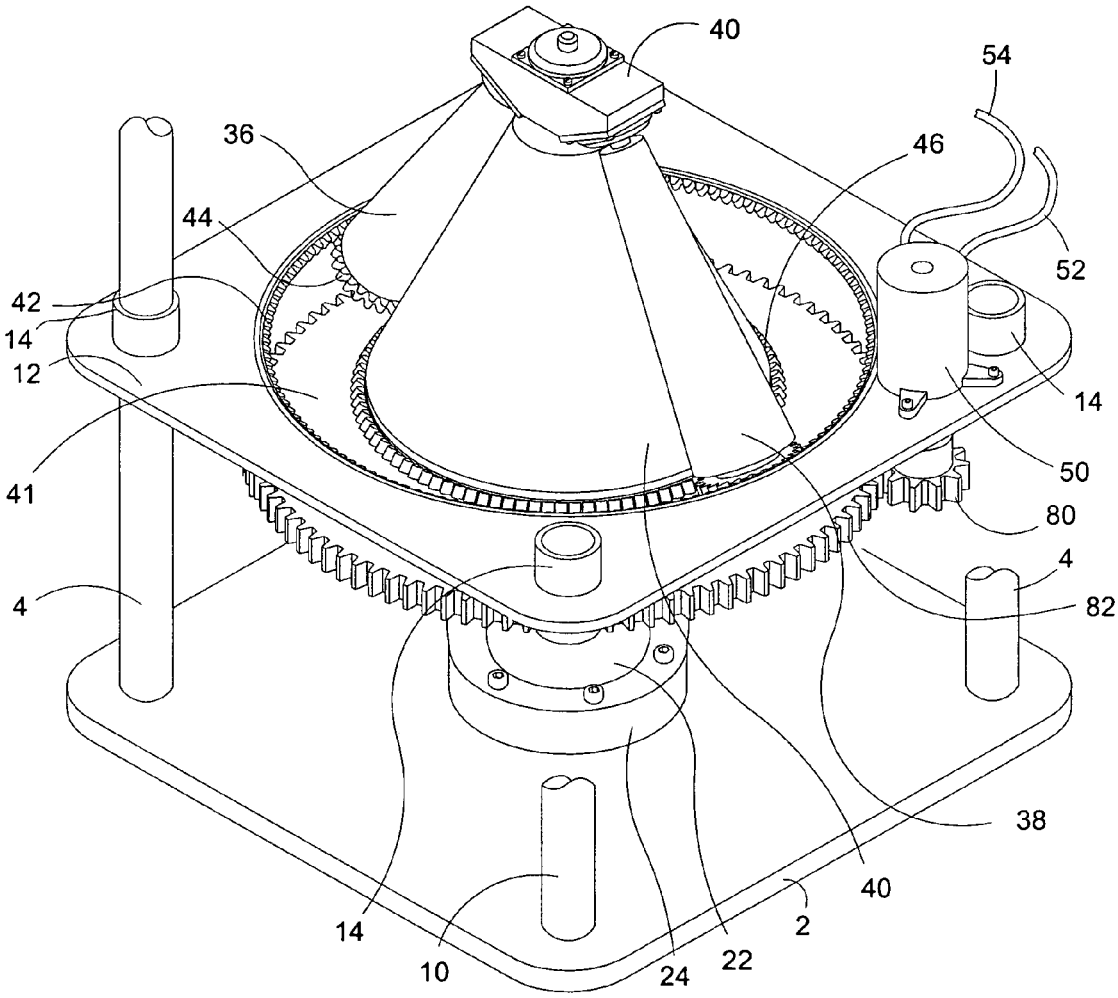
FIG. 2 redepicts FIG. 1, showing upper structures representationally removed.

Referring simultaneously to FIGS. 2 and 3, a base 24 of a hydraulic ram 22 having an extension shaft 30 is fixedly mounted upon the upper surface of base plate 2, the hydraulic ram 22 being powered by hydraulic lines 32 and 34. A rotary bearing 28 interconnects speed reduction power gear 82 with the upper end of shaft 30, and a drive cone 26 is rigidly and fixedly mounted upon the upper surface of gear 82. Orbiting roller cones 36 and 38 are rollably mounted upon drive cone 26 by a three way roller bearing 40. Preferably, the lower periphery of drive cone 26 presents gear teeth 46, such teeth matching gears 44 and 46 which are respectively fixedly attached to or are wholly formed with the bases of orbiting roller cones 36 and 38.

Referring further simultaneously to FIGS. 2 and 3, a mandrel guiding and positioning plate 12 having a central aperture 41 is mounted upon columns 4 via slide sleeves 14. The periphery of aperture 41 preferably presents gear teeth 42 which match gear teeth 44 and 48 of conical orbiting rollers 36 and 38. Upon actuation of hydraulic ram 22 for alternate upward and downward motion, mandrel guiding plate 12 simultaneously upwardly and downwardly moves, such plate 12 being carried by the geared bases of orbiting rollers 36 and 38 and by drive cone 26.

Referring further simultaneously to FIGS. 2 and 3, pinion gear 80 drives speed reduction power gear 82, the pinion gear 80 being driven by hydraulic motor 50, such motor being powered by hydraulic lines 52 and 54. Upon actuation of hydraulic motor 50 to rotate pinion gear 80, drive cone 26 is rotated, and orbiting roller cones 36 and 38 are simultaneously counter-rotated and counter-orbited about drive cone 26. Gear teeth 42, 44, 46, and 48 of the mandrel guiding plate 12, of the roller cones 36 and 38, and of the drive cone 26 provide for such counter-rotation and orbiting motion while maintaining radial alignment of the roller cones, 180° degrees apart. Where three roller cones are provided, a four way bearing may be provided, and such gear configuration may, in a similar fashion, maintain such three rollers at 120° intervals.

In operation of the instant inventive pipe flaring machine, referring simultaneously to all figures, a pipe 62 having a lower end 70 is secured in place by clamping shoes 58 as described above. Preferably, at the commencement of the pipe flaring process, the lower end 70 of the pipe 62 contacts the sloped or flared surfaces of orbiting roller cones 36 and 38 as depicted in FIG. 3. Thereafter, hydraulic motor 50 is actuated, causing cones 36 and 38 to orbit the lower opening of pipe 62 while moving rollably over the drive cone 26. Thereafter, hydraulic ram 22 is actuated to drive the drive cone 26 and the rollers 36 and 38 upwardly into the bore of pipe 62, such rollers simultaneously orbiting and rollably rotating. The upward motion of the rollers occurring simultaneously with their rolling and orbiting movement continues until the rollers and pipe end 70 are configured and arranged as depicted in FIG. 4, effectively producing an outwardly and downwardly extending flare 74 upon the end 70 of pipe 62.

Figure 4:
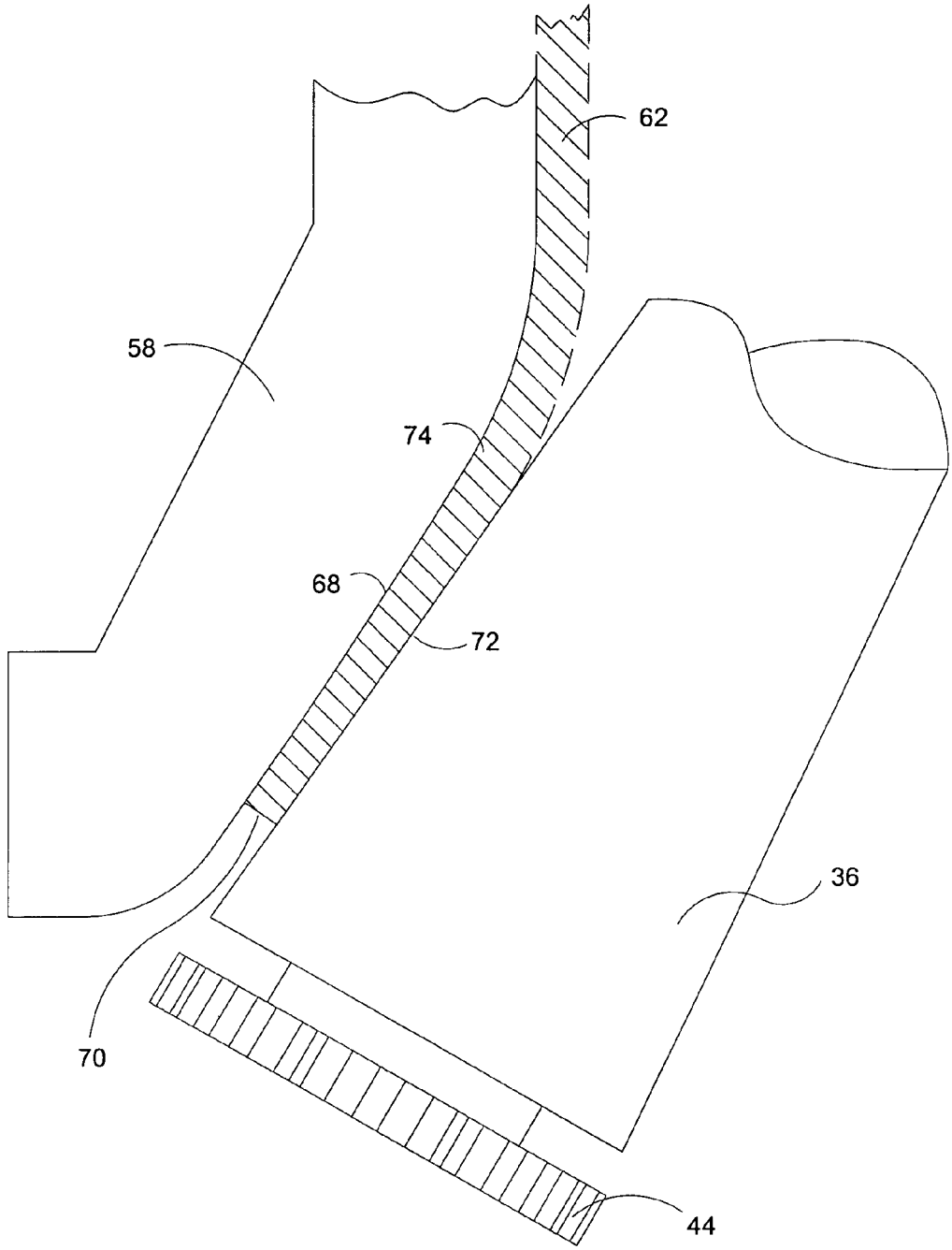
FIG. 4 is a representational magnified detailed view depicting pipe flaring action of the machine.

Referring to FIG. 4, it is preferred that the inner surfaces of the anvil ring segments 68 and the outer surfaces 72 of the roller cones form a slight acute angle with respect to each other so that upon compression and rolling of the lower end 70 of pipe 62, such end is progressively thinned while it is drawn outwardly for prevention of cracking and splitting of such pipe end.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A tube flaring machine comprising:

(a) a frame having an upper end and having a lower end, the frame comprising a plurality of columns;

(b) a tube clamp comprising a plurality of radially arranged shoes, each shoe having a lower end;

(c) clamp attaching means interconnecting the frame and the tube clamp, the clamp attaching means comprising a collet having a bore, the collet interconnecting the shoes and the columns;

(d) a segmented anvil ring having an outwardly and downwardly flared inner surface, each anvil ring segment having an upper end;

(e) anvil ring mounting means positioning the anvil ring below the tube clamp, the anvil ring mounting means comprising fixed attachments of the upper ends of the anvil ring segments to the lower ends of the shoes;

(f) a mandrel having an outwardly and downwardly flared outer surface;

(g) mandrel attaching means interconnecting the mandrel and the frame, the mandrel attaching means positioning the mandrel below the anvil ring; and (h) pressing means operatively connected to the frame, the pressing means being adapted for moving the mandrel and the anvil ring toward each other; the tube clamp further comprising an upper rectilinear motion actuator operatively connected to the shoes, said actuator being adapted for alternately upwardly and downwardly moving the shoes within the bore of the collet.

2. The tube flaring machine of claim 1 wherein the tube clamp further comprises a gantry, and wherein the upper rectilinear motion actuator comprises at least a first fluid pressure actuated cylinder interconnecting the gantry and the shoes.

3. The tube flaring machine of claim 2 wherein the mandrel comprises at least first and second orbiting rollers, and further comprising rotating means operatively connected to said rollers for orbiting and rotating said rollers.

4. The tube flaring machine of claim 3 wherein the at least first and second orbiting rollers are conical, and wherein the mandrel further comprises a drive cone, the at least first and second orbiting rollers being rollably mounted upon the drive cone.

5. The tube flaring machine of claim 4 wherein the frame comprises a base, and wherein the columns have lower ends fixedly attached to the base, wherein the columns extend upwardly from the base, and wherein the mandrel attaching means comprises a mandrel guiding plate interconnecting the at least first and second orbiting rollers and the columns, the mandrel guiding plate being mounted slidably upon the columns, the at least first and second orbiting rollers being further rollably mounted upon the mandrel guiding plate.

6. The tube flaring machine of claim 5 wherein the drive cone has a lower end, and wherein the pressing means comprises a lower rectilinear motion actuator interconnecting the base and the lower end of the drive cone.

7. The tube flaring machine of claim 6 wherein the rotating means further comprises motor means operatively connected to the drive cone.

8. A tube flaring machine comprising:

(a) a frame having an upper end and having a lower end;

(b) a tube clamp;

(c) clamp attaching means interconnecting the frame and the tube clamp;

(d) an anvil ring having an outwardly and downwardly flared inner surface;

(e) anvil ring mounting means positioning the anvil ring below the tube clamp;

(f) a mandrel having an outwardly and downwardly flared outer surface, the mandrel comprising at least first and second rollers, and further comprising orbiting means operatively connected to the rollers, the orbiting means being adapted for moving the rollers orbitally with respect to the anvil ring;

(g) mandrel attaching means interconnecting the mandrel and the frame, the mandrel attaching means positioning the mandrel below the anvil ring; and (h) pressing means operatively connected to the frame, the pressing means being adapted for moving the mandrel and the anvil ring toward each other; the rollers being conical, the orbiting means comprising a drive cone, and the rollers being rollably mounted upon the drive cone.

9. The tube flaring machine of claim 8 wherein the frame comprises a base and a plurality of columns extending upwardly from the base, and wherein the mandrel attaching means comprises a mandrel guiding plate interconnecting the rollers and the columns, the mandrel guiding plate being mounted slidably upon the columns, the rollers being further rollably mounted upon the mandrel guiding plate.

10. The tube flaring machine of claim 9 wherein the drive cone has a lower end, and wherein the pressing means comprises a lower rectilinear motion actuator interconnecting the base and the lower end of the drive cone.

11. The tube flaring machine of claim 10 wherein the orbiting means further comprises motor means operatively connected to the drive cone.

* * * * *